US007914398B2

(12) United States Patent
Tuck et al.

(10) Patent No.: US 7,914,398 B2
(45) Date of Patent: Mar. 29, 2011

(54) GOLF TRAINING AID

(76) Inventors: Vaughan Tuck, Bowmanville (CA); Tim Vanstone, Newcastle (CA)

( * ) Notice: Subject to any disclaimer, the term of this patent is extended or adjusted under 35 U.S.C. 154(b) by 0 days.

(21) Appl. No.: 12/401,413

(22) Filed: Mar. 10, 2009

(65) Prior Publication Data

US 2009/0233727 A1 Sep. 17, 2009

Related U.S. Application Data

(60) Provisional application No. 61/035,202, filed on Mar. 10, 2008.

(51) Int. Cl.
*A63B 69/36* (2006.01)

(52) U.S. Cl. ..... 473/397; 473/400

(58) Field of Classification Search ..... 473/387–403, 473/257; D21/717, 718
See application file for complete search history.

(56) References Cited

U.S. PATENT DOCUMENTS

| | | | | | |
|---|---|---|---|---|---|
| 1,255,140 | A | * | 2/1918 | David | 473/398 |
| 1,510,302 | A | * | 9/1924 | Budrow | 473/392 |
| 1,596,110 | A | * | 8/1926 | Lynch | 473/257 |
| 1,717,962 | A | * | 6/1929 | Deike | 473/397 |
| 1,866,143 | A | * | 7/1932 | Willey | 473/397 |
| 1,942,672 | A | * | 1/1934 | Thompson | 473/392 |
| 2,128,049 | A | * | 8/1938 | Karkoska | 473/257 |
| 2,457,670 | A | * | 12/1948 | Harvey | 473/397 |
| 2,503,591 | A | * | 4/1950 | Parsons | 473/395 |
| 3,883,144 | A | * | 5/1975 | Lazow | 473/257 |
| 3,907,289 | A | * | 9/1975 | Bondu, Sr. | 473/403 |
| 4,181,300 | A | * | 1/1980 | Bradley | 473/257 |
| 5,240,254 | A | * | 8/1993 | Adlam | 473/257 |
| D382,929 | S | * | 8/1997 | DeBlieux et al. | D21/717 |
| 5,766,100 | A | * | 6/1998 | Dilmore | 473/396 |
| 6,899,644 | B1 | * | 5/2005 | Song et al. | 473/397 |
| 7,052,416 | B2 | * | 5/2006 | Chang | 473/396 |
| 2006/0058120 | A1 | * | 3/2006 | Anton | 473/386 |
| 2008/0146383 | A1 | * | 6/2008 | Dandelius | 473/397 |

* cited by examiner

*Primary Examiner* — Steven Wong
(74) *Attorney, Agent, or Firm* — Elias Borges

(57) ABSTRACT

The present invention is a golf swing training aid to help train golfers how to better hit a golf ball with a golf club. The training aid consists of a generally T shaped member having a central portion, an elongated pointer portion extending from the central portion and first and second side arms extending from the central portion in opposite directions. The pointer portion is oriented perpendicular to the first and second side arms. The aid further includes a tower member pivotally connected to the central portion of the T shaped member, the tower member being movable between an upright position wherein the tower member extends perpendicularly upward relative to the central portion and a lowered position wherein the tower member is pivoted towards the pointer portion. The tower member is dimensioned and configured to support a golf ball when the tower member is in its upright position. The central portion of the T shaped member has a space dimensioned and configured to receive the tower member when the tower member is in its lowered position.

2 Claims, 4 Drawing Sheets

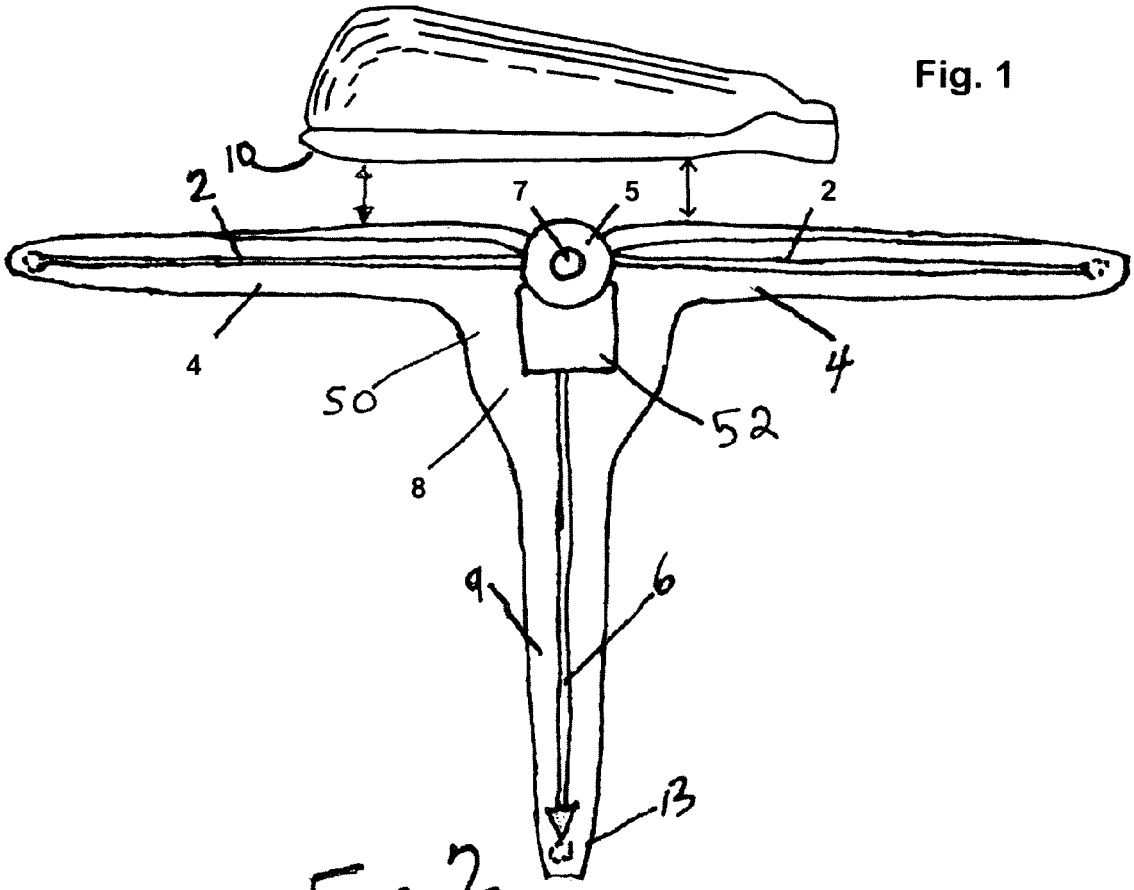
Fig. 1
Fig. 2
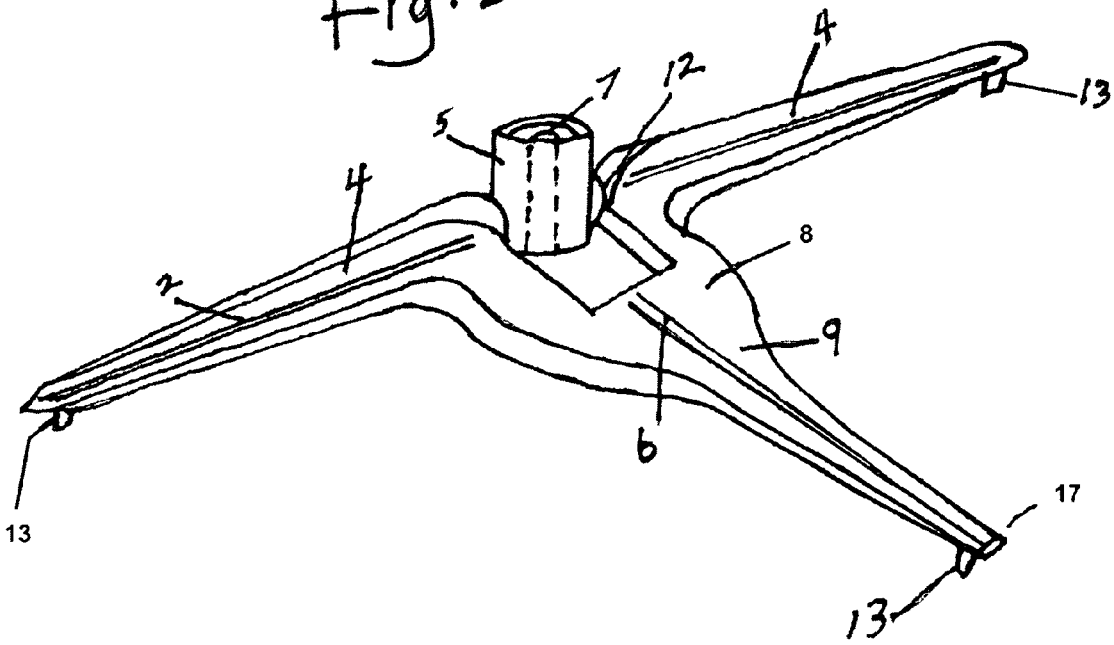

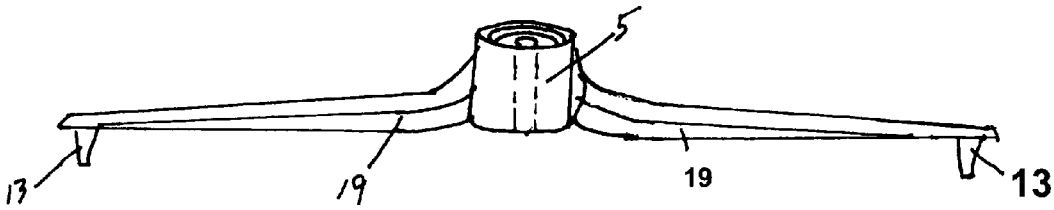
Fig. 3
Fig. 4
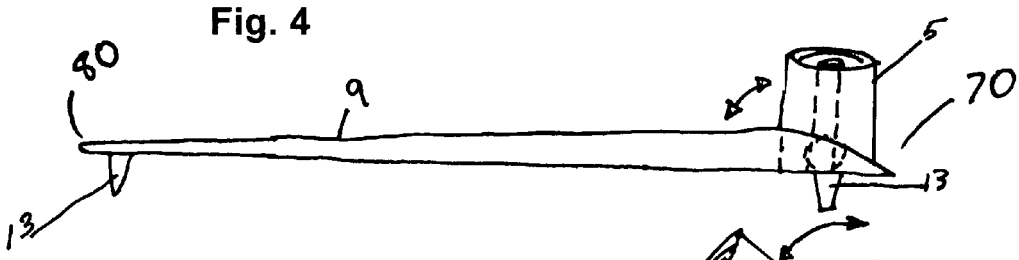
Fig. 5
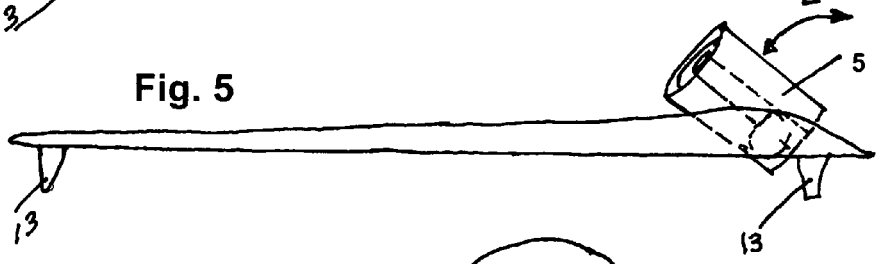
Fig.6
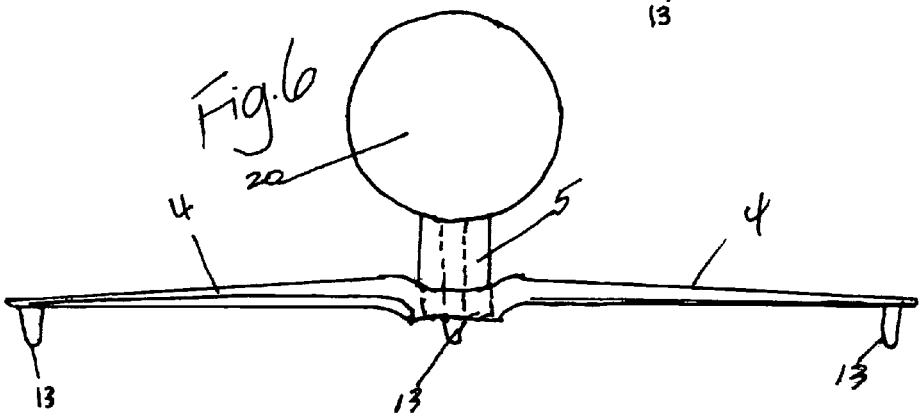

GOLF TRAINING AID

CROSS REFERENCE TO RELATED APPLICATION

This application claims the benefit of Provisional Application Ser. No. 61/035,202 filed Mar. 10, 2008, which is incorporated herein by reference.

FIELD OF THE INVENTION

The invention relates generally to training aids for assisting people on how to properly hit a golf ball with a golf club.

BACKGROUND OF THE INVENTION

Correctly hitting a golf ball with a golf club requires the player to do several things. Training aids for helping people learn how to properly hit a golf ball with a club have been around for quite some time. However, devices which help golfers properly align their club face and swing are often expensive and bulky. Such devices are also impractical to use during a game or at a driving range. An improved golf training aid which is inexpensive to purchase, compact and robust enough to use at the driving range or during an actual golf game would be advantageous.

SUMMARY OF THE INVENTION

The present invention is directed at a golf swing training aid to help train golfers how to better hit a golf ball with a golf club. The training aid consists of a generally T shaped member having a central portion, an elongated pointer portion extending from the central portion and first and second side arms extending from the central portion in opposite directions. The pointer portion is oriented perpendicular to the first and second side arms. The aid further includes a tower member pivotally connected to the central portion of the T shaped member, the tower member being movable between an upright position wherein the tower member extends perpendicularly upward relative to the central portion and a lowered position wherein the tower member is pivoted towards the pointer portion. The tower member is dimensioned and configured to support a golf ball when the tower member is in its upright position. The central portion of the T shaped member has a space dimensioned and configured to receive the tower member when the tower member is in its lowered position.

The present invention is also directed at a golf swing training aid as described above wherein the tower member is positioned relative to the T shaped member such that the tower member is positioned between and aligned with the first and second side arms when the tower member is in its upright position. The tower member is preferably aligned with the pointer portion of the T shaped member such that an axis of the tower member is coplanar with an axis of the pointer portion.

The present invention is also directed at a golf swing training aid as describe above wherein the tower member is substantially coaxially aligned with the pointer portion of the T shaped member when the tower member is in its lowered position. Furthermore, the tower member preferably has an aperture dimensioned to receive the shaft of a golf tee when the tower member is in its upright position, thereby permitting a golfer to place a golf ball on the tee held in the tower member. The T shaped member may also have an aperture formed on its underside along the bottom of the pointer portion which is dimensioned and configured to receive and retain a golf tee.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

The invention will now be described by way of example only with references to the accompanying diagrammatic drawings in which:

FIG. 1 is a plan top view of a golf swing training device made in accordance with the present invention shown in relation to a golf club head.

FIG. 2 is a perspective view of the golf swing training device made in accordance with the present invention FIG. 3 is a rear view of the golf swing training device shown in FIG. 1.

FIG. 4 is a right side view of the golf swing training device shown in FIG. 1 showing the tower portion in its fully upright position.

FIG. 5 is a right side view of the golf swing training device shown in FIG. 1 showing the tower portion moved towards it lowered position.

FIG. 6 is a front view of the golf swing training device made in accordance with the present invention shown in FIG. 1 showing a golf ball placed on top of the tower portion of the invention.

In the drawings like characters of reference indicate corresponding parts in the different figures.

DETAILED DESCRIPTION OF THE INVENTION

Figure 7A:
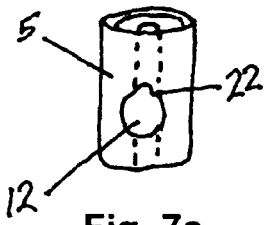
FIGS. 7*a*, and 7*b* are perspective views of the tower portion of the present invention.
Figure 7B:
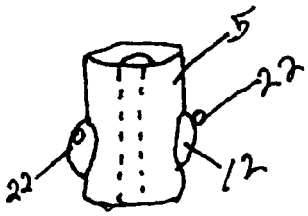
Figure 7C:
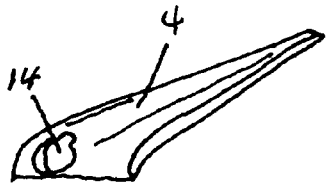
FIG. 7*c* is a perspective view of an arm portion of the present invention showing the socket portion.

A golf swing training aide made in accordance with the present invention is illustrated in FIGS. 1 and 2 as item 100 and consist of a T shaped member 8 having central portion 50 which supports a tower portion 5 and a forwardly facing pointer portion 9 including a straight line indicator 6 in the form of a recessed pointed line. T shaped member 8 also has two opposite extending arms 4 on either side of central portion 50. Tower portion 5 is aligned with side arms 4 and pointer portion 9. Arms 4 are coaxially aligned and pointer portion 9 is perpendicular to arms 4.

Figure 7D:
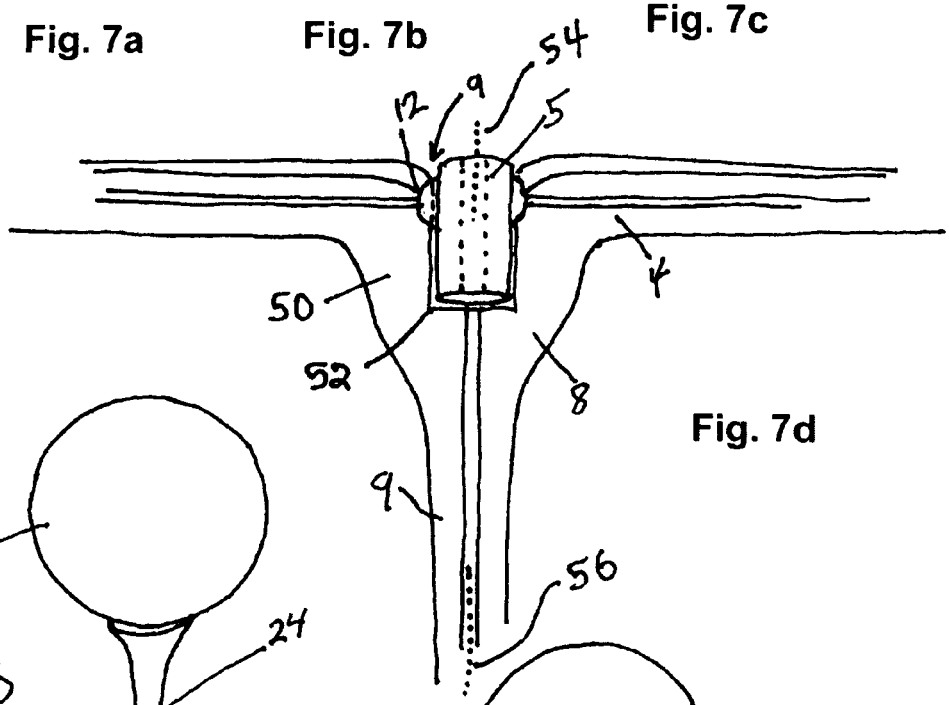
FIG. 7*d* is a top view of the present invention showing the tower portion of the present invention fully tilted into its lowered position.

Tower portion 5 is pivotally connected to central portion 50 and is pivotally movable between a fully upright position as shown in FIGS. 1 and 2 to a fully lowered position as shown in FIG. 7*d*. Central portion 50 of T shaped member 8 has a central aperture 52 which is dimensioned and configured to receive tower portion 5 when the tower portion is in its fully lowered position. Tower portion 5 has an axis 54 which is aligned with axis 56 of pointer portion 9 when the tower portion is in its fully lowered position. When in this fully lowered position, the tower portion and the pointer portion are coaxially aligned.

Returning back to FIGS. 1 and 2, side arms 4 each includes a straight line indicator 2 which may be either a marked line or a recessed line to provide directional alignment of a golf club 10 when addressing golf ball placed on top of tower portion 5. The pointer 9 and arms 4 radiate outwardly from the tower 5, each projecting to a distance beyond the perimeter of the golf ball 20 when located on the tower 5. The straight line indicator 6 is set at 90 degree's to the arms 4, both of which extend at equal lengths. The equal lengths are to ensure that each arm can be seen by a golfer when addressing the ball, for left or right handed golfers respectively. The device is fastened to the ground by locating cleats 13 on the underside of arms 4 and pointer 9.

As shown in FIG. 6, tower portion 5 is dimensioned and configured such that, when it is in its upright position, it can support a golf ball 20. This permits the golf swing training aide to be used on a driving range or golf course without a golf tee. Cleats 13 on the underside of the T shaped member permit the device to be firmly retained to the ground in use, thereby decreasing the likelihood that the device will fly off if accidentally struck by the golf club during use. The pointed tip 80 of pointer portion 9 ensures that if rear portion 70 of the device is struck by a golf club, the rear portion will cause tip 80 to dig into the ground further preventing the device from flying off. This greatly reduces the risk of injury to others. As seen in FIG. 3, the arms 4 have a slight taper 19 to allow an unrestricted pass of the golf club.

Upon impact of a golf club (see item 10 in FIG. 1) tower portion 5 pivots from a vertical towards a horizontal position as shown in FIGS. (4) and (5). This permits the golf club to pass through over pointer portion 9 unobstructed and reduces damage to the device and permitting a more efficient transfer of momentum to the golf ball from the club. By pivoting forward, tower portion 5 also decreases the likelihood that the device will fly off the ground when struck.

Referring now to FIGS. 7*a* through 9, tower portion (5) is attached to central portion 50 of T shaped member (8) by a ball and socket joint 90 consisting of sockets 14 on arms 4 and ball joints 12 on tower 5. The ball and socket joint allows the tower (5) to pivot from an upright or substantially vertical orientation (see FIG. 2) to a lowered or horizontal position as shown in FIG. 7*d* upon impact of the club on ball 20. The tower (5) is configured to be retained in a vertical position by tabs (22). Tabs 22 are configured to hold tower portion 5 in a vertical orientation until a force is applied to the tower portion to force the tabs to disengage and permit the tower portion to pivot towards its lowered position.

Figure 8:
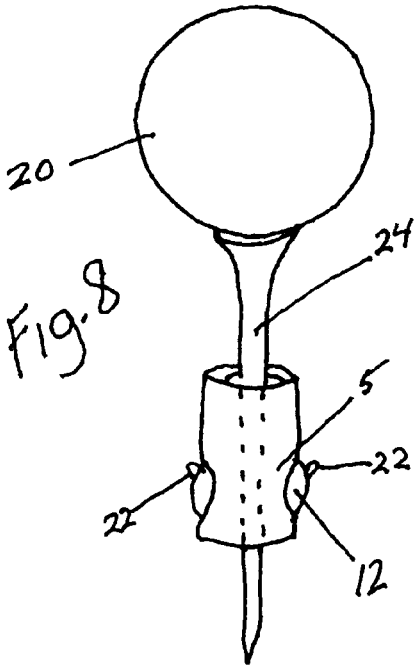
FIG. 8 is a perspective view of a golf ball on a tee mounted to the tower portion of the present invention.
Figure 9:
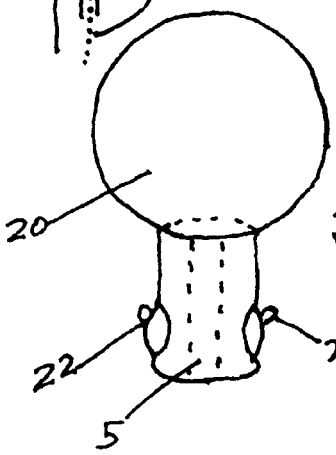
FIG. 9 is a perspective view of a golf ball placed on the tower portion of the present invention without a tee.

FIGS. 8 and 9 illustrate the dual functions of the tower 5 with the ball 20 in a teed position. The tower 5 may be used with a conventional tee 24 inserted through aperture 7 of tower portion 5 to the ground surface. The tower 5 may serve as the tee itself, independent of a conventional tee 24. The approximate shaft diameter of a standard tee is between 0.250 and 0.280 inches. The outside diameter of tower member's 5 centre hole 7 is dimensioned to receive the shaft of tee 24. This allows an interference free insertion of a standard tee 24 (see figure FIG. 8) if desired.

Figure 10:
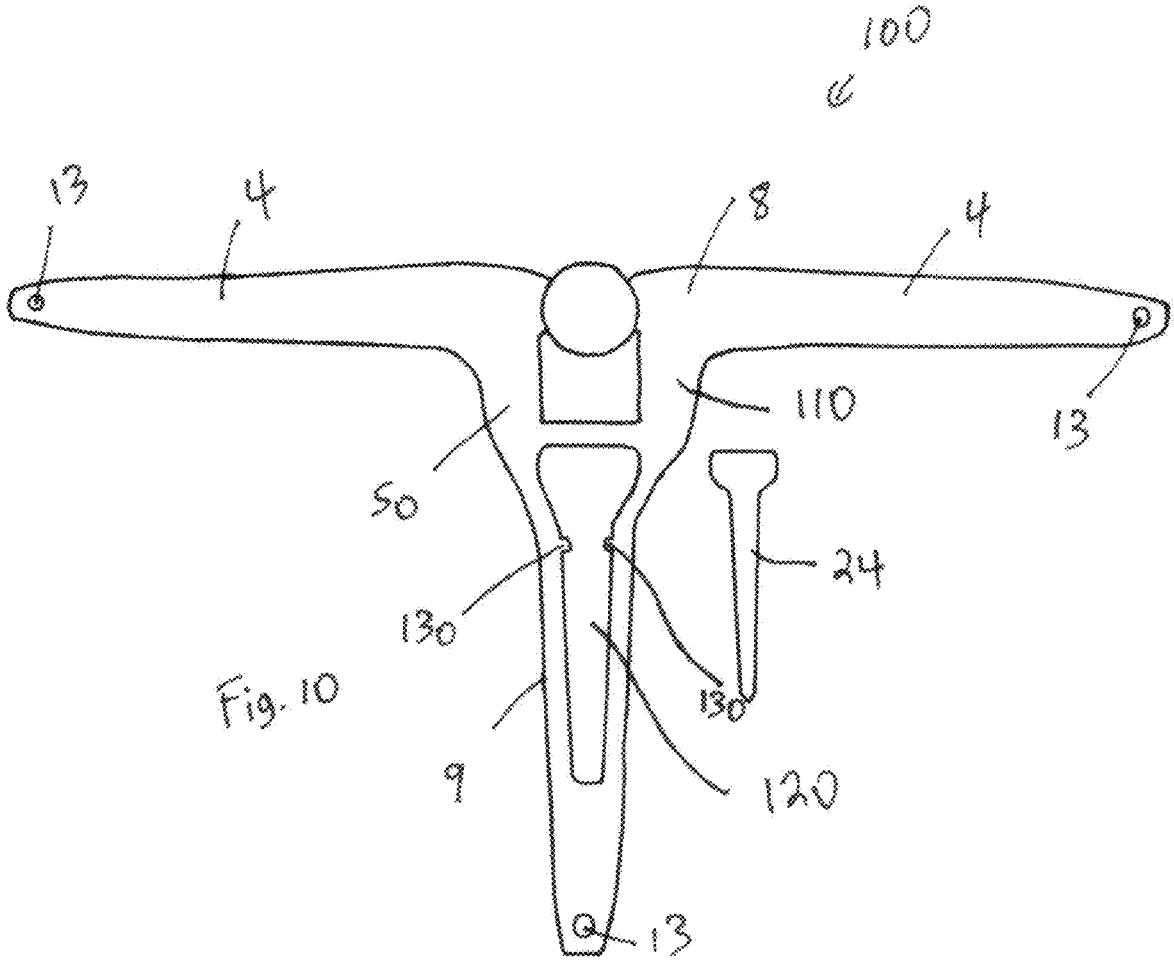
FIG. 10 is an underside view of the golf swing training device made in accordance with the present invention showing the tee retention aperture.

Referring now to FIG. 10, golf swing training aid 100 has an undersurface 110 with an aperture 120 formed beneath pointer portion 9. Aperture 120 is dimensioned to receive golf tee 24. Preferably, nubs 130 are positioned adjacent aperture 120 to secure golf tee 24 when it is inserted into aperture 120. In this way, the device acts not only as a training device but also as a holder and dispenser of a golf tee, permitting the user a choice of how to tee up the golf ball.

Referring now to FIGS. 1 and 2, in use the golf swing training device is positioned in the ground with the straight line indicator 6 of the pointer 9 pointing in the required direction of travel of the golf ball. The golfer then positions himself such that the flat open face of the golf club 10 lies substantially parallel to the indicator 2 of the side arms 4. With the club so aligned the ball should, when struck following a good swing, travel unrestricted in the direction of the indicator line 6 of pointer portion 9. The golfer first sets the training device so that line 6 is aligned with respect to the intended target, then presses down to get cleats 13 to dig into the ground. The golfer then places a ball on tower 5 of the device (see FIG. 6) or uses a standard wooden tee that is inserted into the tower of the device (see FIG. 8). The golfer then sets feet, hips, and shoulders parallel to line 1 at address. Line 2 is used to position the ball in the proper position between the golfer's feet. The position of the ball between the feet will vary depending on choice of club to be used. As shown in FIG. 1, line 2 is used to square the club face with the intended target line. Upon impact line 2 is used as a reference point to weight transfer to forward side in order to keep the momentum traveling in the direction of line 6. Line 6 is then used to keep the golf club along line of intention for as long as possible before finishing with club above the shoulder.

The collapsible tower will not slow club head speed or interfere with club face closure upon impact. The device helps to engrain a confident comfortable and easily repeated proper swing leading to a significantly lower golf score. The present device is superior and innovative to all previously issued patents of similar apertures because of the collapsible towers ability to extricate itself form the point of impact to allow a non-restrictive swing and ball flight. Cleats 13 help to keep the device anchored to the ground even if the back of the device is accidentally hit by club 10. In particular, the tap on the end of arm 9 ensures that if the device is struck from the rear, the forward tip 17 of arm 9 digs into the ground, thereby dissipating the kinetic energy imparted by the club and preventing the device from accidentally being launched forward by the club. The device is thus safer to use because it is less likely that someone will be injured by the device should it be hit by a club and it is less likely that a golfer would have to travel any distance to retrieve the device in the event he or she accidentally hits it with the club.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A golf swing training aid to help train golfers how to better hit a golf ball with a golf club, the training aid comprising:

a generally T shaped member having a central portion, an elongated pointer portion extending from the central portion and first and second side arms extending from the central portion in opposite directions, the pointer portion being perpendicular to the first and second side arms;

a tower member pivotally connected to the central portion of the T shaped member, the tower member being movable between an upright position wherein the tower member extends perpendicularly upward relative to the central portion and a lowered position wherein the tower member is pivoted towards the pointer portion;

the tower member being dimensioned and configured to support a golf ball when the tower member is in its upright position;

the central portion of the T shaped member having a space dimensioned and configured to receive the tower member when the tower member is in its lowered position, and wherein, the T shaped member has an aperture formed on a bottom surface of the pointer portion of the T shaped member, said aperture being dimensioned and configured to receive and retain a golf tee.

2. The golf swing training aide of claim 1 wherein the tower member has an aperture dimensioned to receive a shaft of the golf tee when the tower member is in its upright position.

* * * * *